US006386467B1

(12) United States Patent
Takeda

(10) Patent No.: US 6,386,467 B1
(45) Date of Patent: May 14, 2002

(54) INJECTORS

(75) Inventor: Sumito Takeda, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/579,712

(22) Filed: May 26, 2000

(30) Foreign Application Priority Data

Jun. 29, 1999 (JP) ..... 11-183631

(51) Int. Cl.[7] ..... B05B 1/30; F02M 51/00

(52) U.S. Cl. ..... 239/585.5; 239/585.1; 239/DIG. 19; 335/256; 251/129.1

(58) Field of Search ..... 239/585.1, 585.4, 239/585.5, 600, DIG. 19; 335/256, 266; 251/129.1, 129.09, 129.15; 29/602.1

(56) References Cited

U.S. PATENT DOCUMENTS

| | | | | |
|---|---|---|---|---|
| 4,004,343 A | | 1/1977 | Marsden | |
| 4,007,880 A | | 2/1977 | Hans et al. | |
| 4,342,443 A | * | 8/1982 | Wakeman | 239/585.1 X |
| 4,681,143 A | * | 7/1987 | Sato et al. | 251/129.1 X |
| 4,682,135 A | * | 7/1987 | Yamakawa | 335/256 |
| 4,972,996 A | * | 11/1990 | Cerny | 239/585.1 |
| 5,178,362 A | | 1/1993 | Vogt et al. | |
| 5,468,522 A | | 11/1995 | Honkura et al. | |
| 5,769,391 A | | 6/1998 | Noller et al. | |
| 5,944,262 A | | 9/1999 | Akutagawa et al. | |
| 5,986,530 A | | 11/1999 | Nippert et al. | |
| 6,036,120 A | | 3/2000 | Varble et al. | |
| 6,186,472 B1 | | 2/2001 | Reiter | |

FOREIGN PATENT DOCUMENTS

| | | |
|---|---|---|
| DE | 197 44 739 A1 | 4/1999 |
| EP | 0271425 | 6/1988 |
| GB | 2262659 | 6/1993 |
| JP | 4-88577 | 7/1992 |
| JP | 05164013 | 6/1993 |
| JP | 05237678 | 9/1993 |
| JP | 6-8749 | 2/1994 |
| JP | 06074124 | 3/1994 |
| JP | 06084629 | 3/1994 |
| JP | 07103354 | 4/1995 |
| JP | 7-189852 | 7/1995 |
| JP | 07239050 | 9/1995 |
| JP | 09312208 | 12/1997 |
| JP | 10339240 | 12/1998 |
| JP | 11062710 | 3/1999 |

* cited by examiner

*Primary Examiner*—Steven J. Ganey
(74) *Attorney, Agent, or Firm*—Dennison, Schneiner & Schultz

(57) ABSTRACT

An integrally formed cylinder 2 having alternating magnetic 2*b*, 2*d* and non-magnetic portions 2*a*, 2*c*, 2*e* for use in an injector. At least two solenoid coils 12, 14 are disposed about the cylinder 2 to urge an armature 4*b* to open and close a valve 4*a*. The non-magnetic portions 2*a*, 2*c*, 2*e* of the cylinder 2 ensure that magnetic paths for opening and closing the valve are magnetically insulated from each other. The integrally formed cylinder 2 is leak proof and thus does not require O-rings or other sealing structures for sealing the fuel path 4*e*, 4*f* from the solenoid coils 12, 14. A protrusion 2*z* may be formed on the cylinder 2 to assist in positioning the solenoid coils 12, 14.

34 Claims, 8 Drawing Sheets

INJECTORS

BACKGROUND OF THE INVENTION

1. Field of the Invention

The present invention relates to injectors, including for example fuel injectors, having two or more solenoid coils that are provided to reciprocally move an armature connected to a valve and more specifically, relates to injectors having an integrally formed common cylinder that comprises alternating non-magnetic and magnetic portions.

2. Description of the Related Art

In known injectors, an electromagnetic force generated by a solenoid coil controls the opening and closing of a valve. When current is supplied to the solenoid coil, the valve moves to the open position as a result of the electromagnetic force acting on a magnetic armature that is coupled to the valve. A spring disposed within the injector causes the valve to return to the closed position when the current is stopped. However, known injector valves do not quickly return to the closed position after the current is stopped, because the return biasing force of the spring is generally insufficient to quickly close the valve.

In Japanese Patent Laid-Open Publication No. 7-239050 a second solenoid coil is provided to assist in controlling the position of the fuel valve. FIG. 8 herein represents relevant aspects of the injector taught by FIG. 12 of JP 7-239050. As shown in FIG. 8, two solenoid coils S1 and S2 are coaxially disposed in corresponding valve-open and valve-closed positions with respect to the movable armature 86. The armature 86 is coupled to the fuel valve 85 and thus moves together with the fuel valve 85. When current is supplied to solenoid coil S1, the electromagnetic force generated by solenoid coil S1 forces the movable armature 86 towards the valve-opening direction and the fuel valve 85 moves into the open position. When current is supplied to solenoid coil S2, the electromagnetic force generated by solenoid coil S2 forces the movable armature 86 toward the valve-closing direction. Moreover, a spring (not shown) is provided to assist in biasing the fuel valve 85 toward the valve-closed position. Thus, the combined force of the spring and the electromagnetic force of solenoid S2 acting on the movable armature 86 causes the fuel valve 85 to quickly return to the valve-closed position.

As further shown in FIG. 8, a first magnetic path 80 causes the movable armature 86 to move towards the valve-open position and a second magnetic path 87 causes the movable armature 86 to move towards the valve-closed position. In order to adequately control the valve opening/closing operation, the two magnetic paths must be magnetically insulated from each other. Consequently, according to JP 7-239050, a first inner core 81 is disposed on the inner side of solenoid coil S1 and a corresponding first outer core 82 is disposed on the outer side of solenoid coil S1. Moreover, a second inner core 84 is disposed on the inner side of solenoid coil S2 and a second outer core 83 is disposed on the outer side of solenoid coil S2. A non-magnetic spacer 88 is disposed between the first outer core 82 and the second outer core 83 in order to magnetically insulate the first magnetic path 80 from the second magnetic path 87. Finally, a non-magnetic clamp 89 fixes the first outer core 82 and the second outer core 83 with the non-magnetic spacer 88 sandwiched between the first, outer core 82 and the second outer core 83.

A recess 90 is provided between the first inner core 81 and the second inner core 84. By disposing the movable armature 86 within this recess 90, the first magnetic path 80 extends from the first inner core 81 over the movable armature 86 to the first outer core 82. Similarly, the second magnetic path 87 extends from the second inner core 84 over the movable armature 86 to the second outer core 83. The axial length of the movable armature 86 is slightly less than the axial length of the recess 90, so that the movable armature 86 can slide within the recess 90. O-rings (not shown) are provided at various locations to seal the fuel passage from solenoid coils S1 and S2 in order to prevent fuel from leaking from the recess 90 and entering solenoid coils S1 and S2.

According to JP 7-239050, the parts related to the first solenoid coil S1 (solenoid coil S1, inner core 81, outer core 82) and the parts related to the second solenoid coil S2 (solenoid coil S2, outer core 83, inner core 84) are positioned and fixed by the clamping member 89 via the spacer 88. Thus, a relatively large number of parts is required to construct the injector and moreover, it is very difficult to precisely position the various parts during the construction of the injector. For example, coaxial positioning of the inner cores 81 and 84 of the respective solenoid coils S1 and S2, or of the outer cores 82 and 83 is especially difficult. As a result of inevitable errors in positioning the various parts, such fuel injectors do not have reliable dynamic properties.

SUMMARY OF THE INVENTION

It is therefore an object of the present invention to teach improved injectors.

In one aspect of the present teaching, a common member or cylinder is disposed within an injector and the common cylinder has integrally formed magnetic and non-magnetic portions. In another aspect of the present teachings, injectors having at least two coaxially disposed solenoid coil s are taught and the common cylinder is disposed either inside or outside of the two solenoid coils. A portion of the common cylinder t hat is disposed adjacent to a space between the two solenoid coils is non-magnetic. Such a structure can insulate the magnetic path for the valve-open position from the magnetic path for the valve-closed position.

Because the common cylinder can comprise a single part, the number of parts necessary to construct a two solenoid coil injector can be significantly reduced over the known art. Also, because the solenoid coils are positioned, with respect to a single common cylinder, positioning of the various parts can be precisely performed when assembling the injector. Thus, reliable magnetic paths and reliable performance are now possible for a two solenoid coil injector.

In another aspect of the present teachings, the common cylinder is disposed inside the solenoid coils. Moreover, the common cylinder may preferably further include non-magnetic portions at positions along the common cylinder that correspond to the valve-open position and/the valve-closed position. According to this structure, the magnetic paths formed by the respective solenoid coils can be prevented from forming a short circuit that does not pass over a movable armature, which is coupled to the valve. Moreover, such a common cylinder has a smooth water-tight surface that allows the movable armature to move smoothly with respect to the common cylinder. Further, fuel leaks from the injector can be prevented, because the fuel path is sealed from the solenoid coils by the common cylinder.

Methods are also taught for preparing common cylinders having integrally formed non-magnetic portions. In one aspect, a representative method includes forming a common cylinder by cutting grooves in a magnetic tubular material and filling the grooves with a non-magnetic material. The magnetic and non-magnetic materials are then fused together to form a water tight common cylinder. The common cylinder is machined to remove magnetic portions adjacent to non-magnetic portions and to provide a smooth, precision finished shape for the common cylinder. Thus, a water-tight common cylinder that provides magnetic insulation between the magnetic paths of a first and second solenoid coil is now possible.

Other objects, features and advantages of the present invention will be readily understood after reading the following detailed description together with the accompanying drawings and the claims.

DETAILED DESCRIPTION OF THE INVENTION

Figure 1:
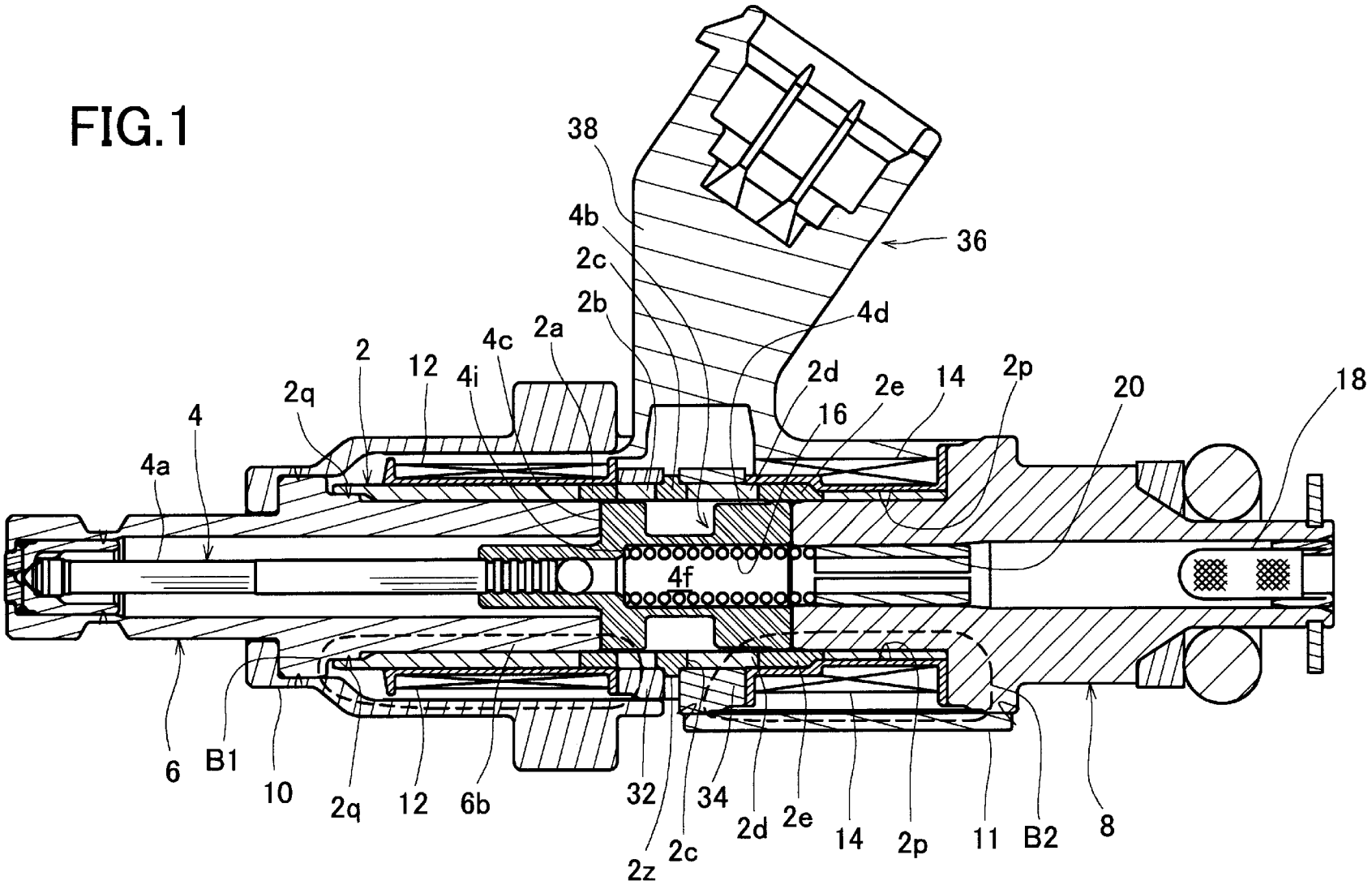
FIG. 1 shows a vertical cross-sectional view of a representative injector constructed according to the present teachings.

In one aspect, injectors are taught having at least two coaxially disposed solenoid coils separated by a space. A reciprocally movable, magnetic armature is preferably disposed adjacent to the space between the solenoid coils and is coupled to a valve. Therefore, the valve will move together with the armature and movement of the armature causes the valve to move between a valve open position and a valve closed position. Preferably, the solenoid coils are disposed with respect to the armature, such that one solenoid coil will force the magnetic armature (and thus the valve) into a valve-open position and the other solenoid coil will force the magnetic armature (and thus the valve) into a valve-closed position. A common cylinder is disposed in relation to the two solenoid coils and the armature, either between the solenoid coils and the armature or outside of both the solenoid coils and the armature. Preferably, a portion of the common cylinder that is disposed adjacent to a space between the two solenoid coils is non-magnetic. More preferably, the common cylinder is integrally formed and is therefore, leak proof. That is, the magnetic and non-magnetic portions are integrally formed within a single cylinder or tubular structure.

In another aspect of the present teachings, the two solenoid coils are coaxially disposed on the outside of the common cylinder and the armature is slidably received within the common cylinder.

The common cylinder also may preferably include non-magnetic portions that are disposed adjacent to the valve-opening solenoid coil and the value-closing solenoid coil. Thus, at least three separate non-magnetic portions may be integrally formed within the common cylinder and the magnetic portions are disposed between the non-magnetic portions.

The common cylinder can, for example, be manufactured by cutting grooves in a tube made of magnetic material. Non-magnetic material is then placed into the grooves and fused with the magnetic materials to form a water-tight tube. This tube is then machined and finished to remove magnetic material disposed to the interior of the non-magnetic material, thereby forming a common cylinder having alternating magnetic and non-magnetic portions. Alternatively, the tube may be made of a non-magnetic material and magnetic material may be introduced into the grooves.

Throughout this specification, "magnetic" is intended to mean materials having a low magnetic resistance, whereas "non-magnetic" is intended to mean materials having a high magnetic resistance. Thus, these terms are not required to be interpreted in an absolute manner. "Magnetic" materials may be either permanently magnetized materials or materials that are influenced by a magnetic field, for example iron. "Non-magnetic" materials generally include, but are not limited to, materials that are not influenced by a magnetic field.

Each of the additional features and method steps disclosed above and below may be utilized separately or in conjunction with other features and method steps to provide improved injectors and methods for making and using the same. Representative examples of the present teachings, which examples will be described below, utilize many of these additional features and method steps in conjunction. However, this detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the present teachings in the broadest sense, and are instead taught merely to particularly describe representative and preferred embodiments of the present teachings, which will be explained below in further detail with reference to the figures.

Figure 2:
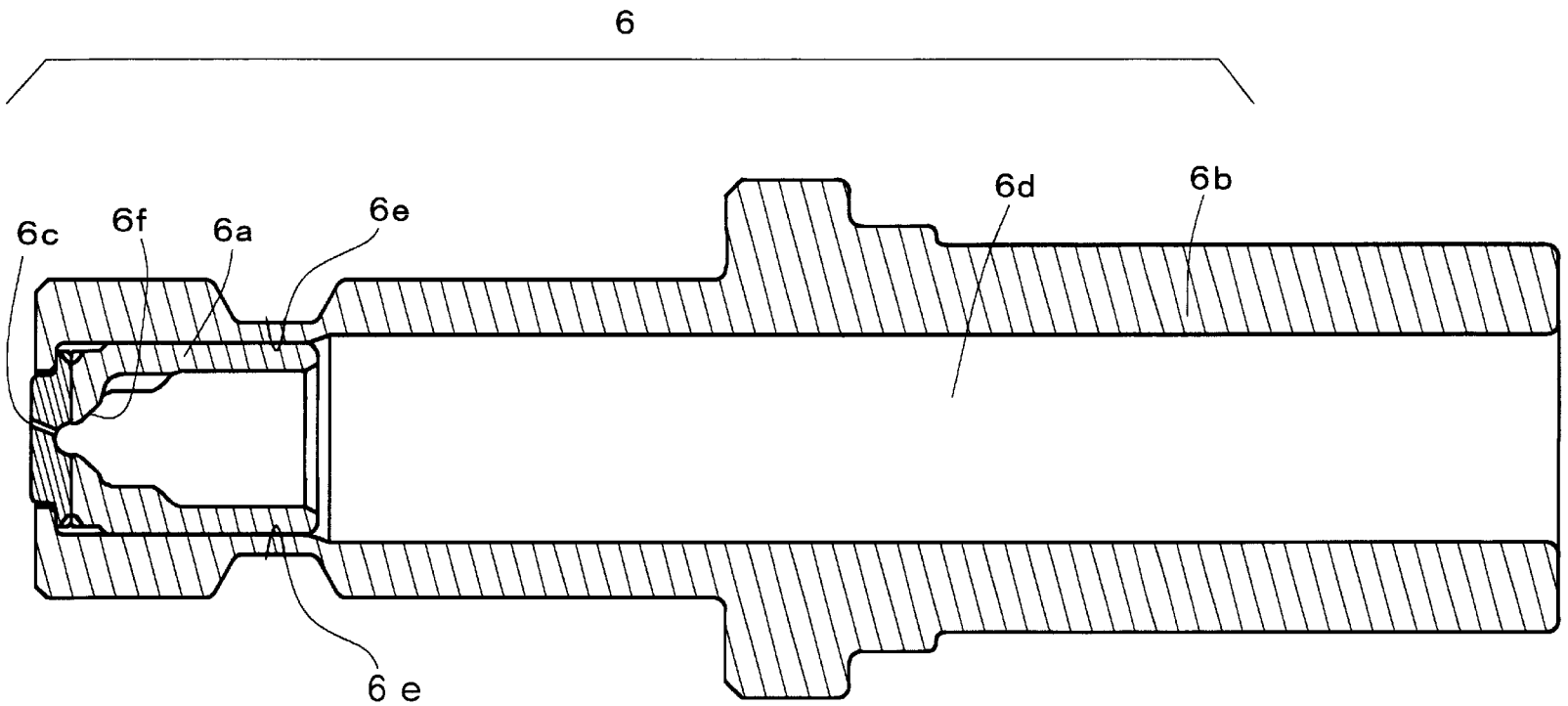
FIG. 2 is a cross-section of the nozzle assembly of the representative injector.
Figure 3:
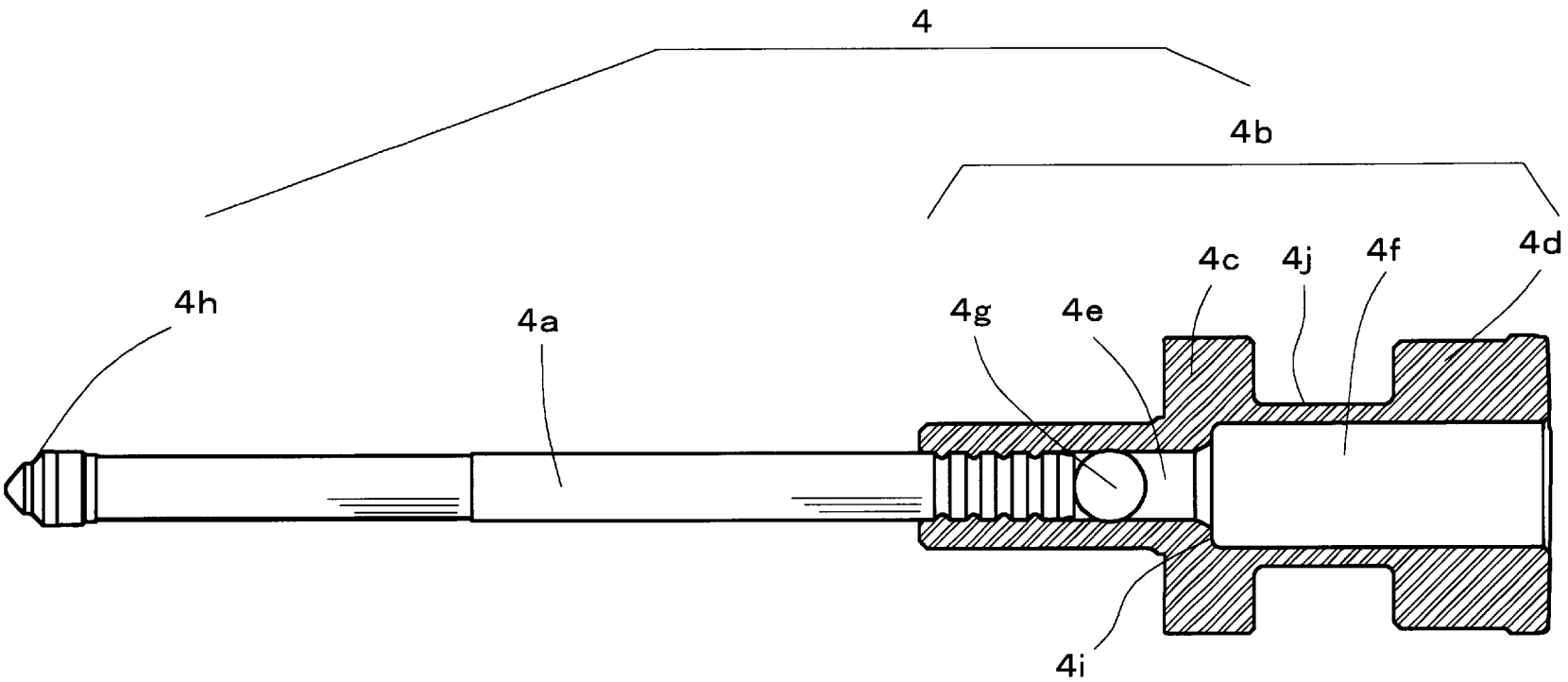
FIG. 3 is a cross-section of the valve assembly of the representative injector.
Figure 4:
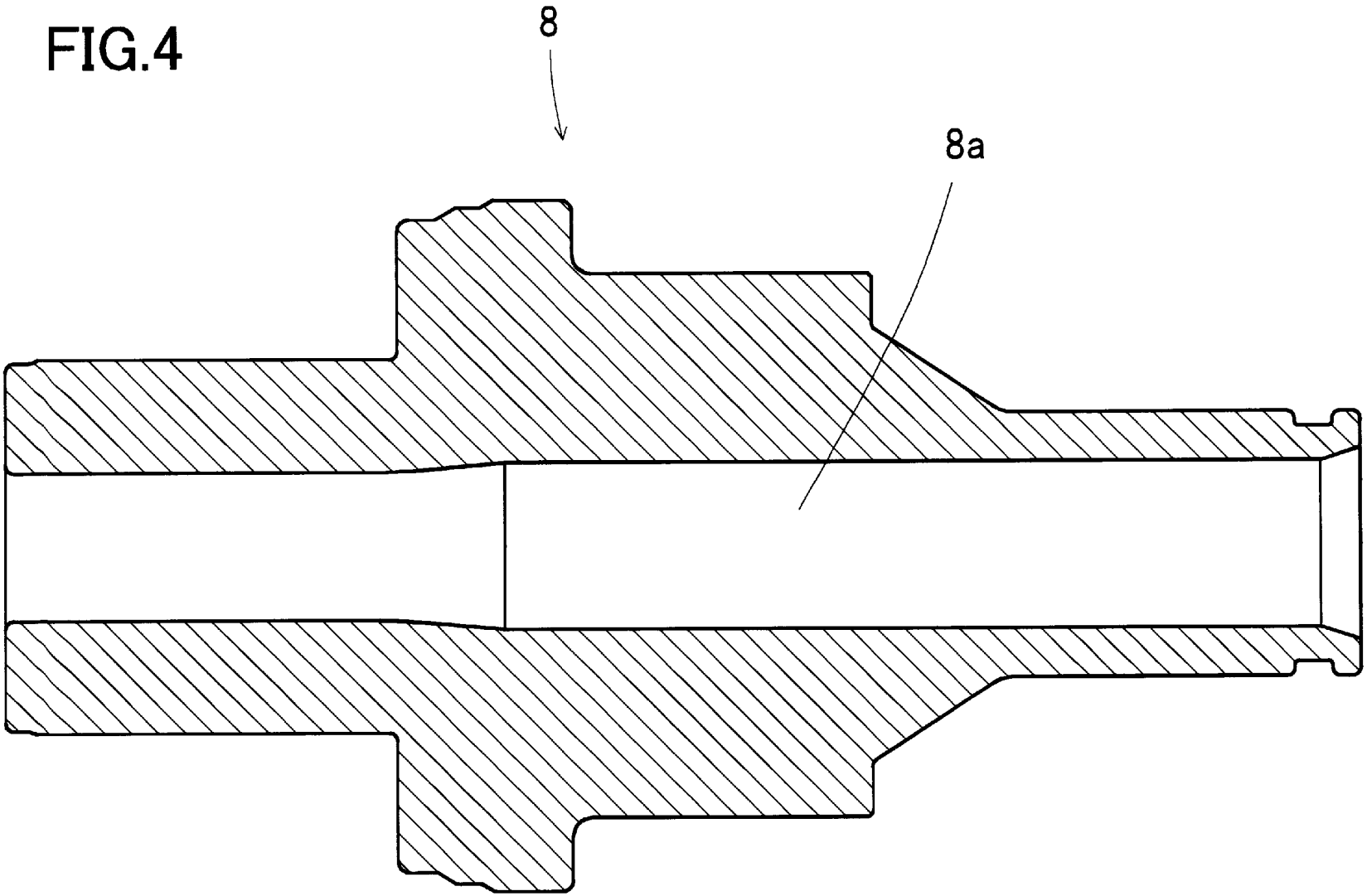
FIG. 4 is a cross-section of the core of the representative injector.
Figure 5:
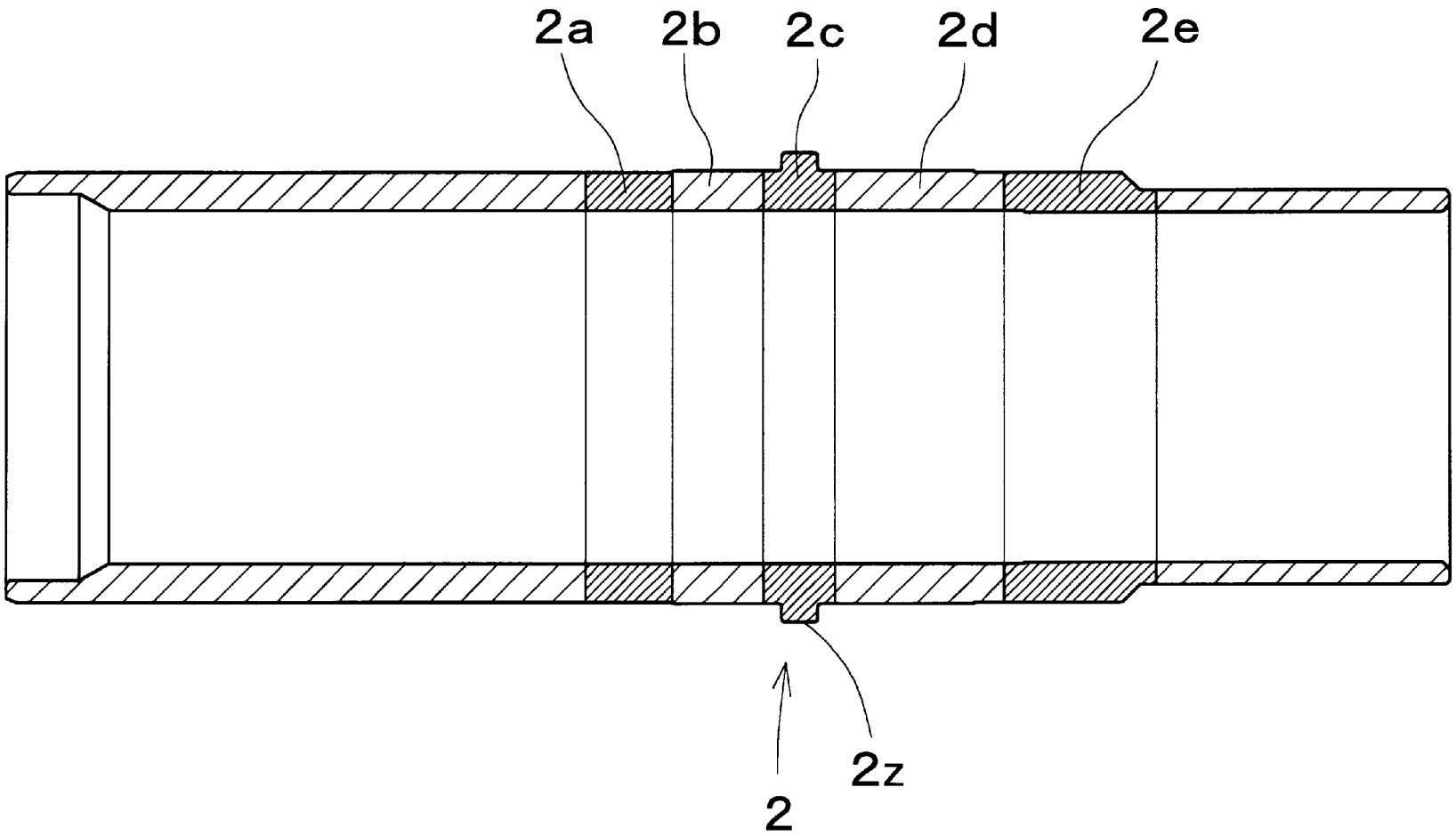
FIG. 5 is a cross-section of the common cylinder of the representative injector.

FIG. 1 is a vertical cross-sectional view of the representative injector, which can be constructed by assembling the representative nozzle assembly 6 shown in more detail in FIG. 2, the representative valve assembly 4 shown in more detail in FIG. 3, the representative core or body 8 shown in more detail in FIG. 4 and the representative common cylinder 2 shown in more detail in FIG. 5. In one preferred method of assembling the representative structures, the valve assembly 4 is slidably received within the nozzle assembly 6. This nozzle assembly 6 can be inserted from the left in FIG. 1 into the common cylinder 2 and the nozzle assembly 6 can be fixed within the common cylinder 2. The core 8 can be inserted from the right into the common cylinder 2 and fixed within the common cylinder 2.

As is shown in FIG. 2, the representative nozzle assembly 6 is made by attaching a nozzle **6*a* to the inner side of the tip of a nozzle cylinder 6*b*. Preferably, the nozzle 6*a* can be inserted into the inner side of the tip of the nozzle cylinder 6*b* and the nozzle 6*a* is then laser-welded to the nozzle cylinder 6*b* by irradiating a laser beam along ring 6*e* on outside the nozzle cylinder 6*b*. A fuel injection hole 6*c* is formed within the tip portion of the nozzle 6*a*. Thus, when the fuel valve (described below), which is slidably received within the nozzle assembly 6, moves towards the valve closing direction, the fuel valve abuts against the valve seat 6*f* without a clearance, thereby closing the fuel path 6*d*. When the fuel valve moves in the valve opening direction, the fuel valve separates from the valve seat 6*f* and fuel is exhausted from the fuel injection hole 6*c***.

As is shown in FIG. 3, the representative valve assembly 4 may include a rod-shaped tip disposed on the forward end of the fuel valve 4*a*, which fuel valve 4*a* may be press-fitted into a movable cylindrical core or armature 4*b*. Preferably, the reciprocally movable armature 4*b* is made of a magnetic material (e.g., a permanently magnetized material or a "soft" magnetic material that does not emit a magnetic field, but is influenced by a magnetic field) and may have a front magnetic pole 4*c* and a rear magnetic pole 4*d*. That is, the armature 4*b* may have a thin portion 4*j* disposed between the two thicker poles 4*c* and 4*d*.

Fuel path 4*e* and fuel path 4*f* are formed within a central passage of the armature 4*b* and through hole 4*g* may extend in an orthogonal direction with respect to the fuel path 4*e*. Fuel path 4*f* may have a larger diameter than fuel path 4*e*. A stepped portion 4i may be formed at the intersection of larger fuel path 4*f* and smaller fuel path 4*e*. A ring-shaped sealing face 4*h* may be disposed near the rod-shaped tip of the fuel valve 4*a*, which sealing face 4*h* can abut against the valve seat 6*f* without clearance when the fuel valve 4*a* is advanced towards the fuel path closing position (i.e. valve closing position).

As is shown in FIG. 4, a fuel path 8*a* is formed in and along the central axis of the substantially tubular core or body 8. Preferably, the core 8 also is made of a magnetic material.

The representative common cylinder 2 is shown in FIG. 5 and comprises nonmagnetic portions 2*a*, 2*c* and 2*e*. Magnetic portions 2*b* and 2*d* are disposed between the three non-magnetic portions 2*a*, 2*c* and 2*e*. The representative cylinder 2 may be integrally formed, for example, by fusing the magnetic and non-magnetic portions to thereby form a leak proof fuel passage within the cylinder 2. A representative method for making the representative cylinder 2 will be explained below with reference to FIGS. 6 and 7.

As shown in FIG. 1, the nozzle assembly 6, which slidably accommodates the valve assembly 4, is inserted from the left into the common cylinder 2, and the nozzle assembly 6 and the common cylinder 2 are welded together in a water-tight or leak proof fashion by irradiating a welding laser beam along ring 2*q* on the outer periphery of the common cylinder 2. The core 8 is inserted into the common cylinder 2 from the right and the core 8 and the common cylinder 2 are welded together in a water-tight or leak proof fashion by irradiating a welding laser beam along ring 2*p* on the outer periphery of the common cylinder 2. In this configuration, the valve assembly 4 can slide within the nozzle assembly 6 over only a short distance.

Further, a valve-opening solenoid coil 14 and a valve-closing solenoid coil 12 may be coaxially disposed around the common cylinder 2. A first ring-shaped magnetic member 34 may be disposed around the common cylinder 2 to the left of the valve-opening solenoid coil 14 as shown in FIG. 1. The first ring-shaped magnetic member 34 preferably assists in the valve opening operation. Similarly, a second ring-shaped magnetic member 32 may be disposed around the common cylinder 2 to the right of the solenoid coil 12. The second ring-shaped member 32 preferably assists in the valve closing operation. A substantially cylindrical first magnetic body case 11 is fixed to the outer perimeter of the solenoid coil 14 and may assist the valve opening operation. Similarly, a substantially cylindrical second magnetic body case 10 can be fixed to the outer perimeter of the solenoid coil 12 and may assist the valve closing operation. The body cases 10 and 11 can be laser-welded to the nozzle assembly 6 and the core 8, respectively.

Plastic member 38 may be disposed on the outer perimeter between the substantially cylindrical first body case 11 and second body case 10. A socket 36 may be formed together with the plastic member 38.

A spring 16 may be inserted into the large diameter fuel path 4*f* of the movable armature 4*e*. The spring 16 preferably provides a permanent axial load or force on the armature 4*e*. Because spring 16 abuts the armature 4*b* at the stepped portion 4*i*, it exerts a constant spring force on the armature 4*b* and thus, biases the fuel valve 4*a* toward the valve closing direction. A spring fixing pipe 20 may be provided to adjust the amount of spring force that is applied to the armature 4*e*. Pipe 20 may be permanently fixed within the core 8 after the insertion depth has been adjusted to provide a predetermined spring force. A strainer 18 may optionally be provided to filter contaminants from the fuel.

As is shown in FIG. 1, the common cylinder 2 is preferably disposed inside the two solenoid coils 12 and 14 and has a non-magnetic portion or region 2*c* disposed adjacent to the space between the two solenoid coils 12 and 14. Further, the common cylinder 2 may have a non-magnetic portion or region 2*a* disposed adjacent to a position in which the front magnetic pole 4*c* of the movable armature 4*b* abuts the nozzle cylinder 6*b*. Similarly, the common cylinder 2 may have a non-magnetic portion or region 2*e* disposed adjacent to a position in which the rear magnetic pole 4*d* of the movable armature 4*b* abuts the core 8.

Due to the non-magnetic portion 2*c* disposed between the two solenoid coils 12 and 14, the magnetic path B2 for opening the valve is magnetically insulated from the magnetic path B1 for closing the valve. Further, due to the non-magnetic portion 2*a* disposed adjacent to the location in which the front magnetic pole 4*c* abuts the nozzle cylinder 6*b*, the magnetic path B1 passes through the small gap formed at the position in which the front magnetic pole 4*c* abuts the nozzle cylinder 6*b*. Also, due to the non-magnetic portion 2*e* disposed adjacent to the location in which the rear magnetic pole 4*d* abuts the core 8, the magnetic path B2 passes through the small gap formed at the position in which the rear magnetic pole 4*d* abuts the core 8. Thus, magnetic short-circuits through the common cylinder 2 can be prevented.

While magnetic regions 2*b* and 2*d* are necessary to provide magnetic paths for armature 4*b* and non-magnetic region 2*c* is necessary to provide insulation between the two magnetic paths, non-magnetic regions 2*a* and 2*e* are optional. Thus, non-magnetic regions 2*a* and 2*e* can be replaced with magnetic regions, if desired. If non-magnetic region 2*a* is provided, preferably it is non-magnetic at least at the portion of the cylinder 2 that is adjacent to the position in which the front magnetic pole 4*c* abuts the nozzle cylinder 6*b*. Similarly, if the non-magnetic region 2*e* is provided, preferably it is non-magnetic at least at the portion of the cylinder 2 that is adjacent to the position in which the rear magnetic pole 4*d* abuts the core 8. Thus, magnetic region 2*b* is preferably disposed at a position corresponding to the front magnetic pole 4*c* and magnetic region 2*d* is preferably disposed at a position corresponding to the rear magnetic pole 4*d*. Preferably, both non-magnetic modified portions 2*a*, 2*c* and 2*e* and magnetic regions 2*b* and 2*d* are formed around the entire perimeter of cylinder 2 and each have a uniform width in the axial direction. Non-magnetic region 2*c* may also preferably include a protruding portion 2*z* that can assist in precisely positioning and assembling the ring shaped magnetic members 32, 34 and the solenoid coils 12 and 14 with respect to the cylinder 2.

Figure 6:
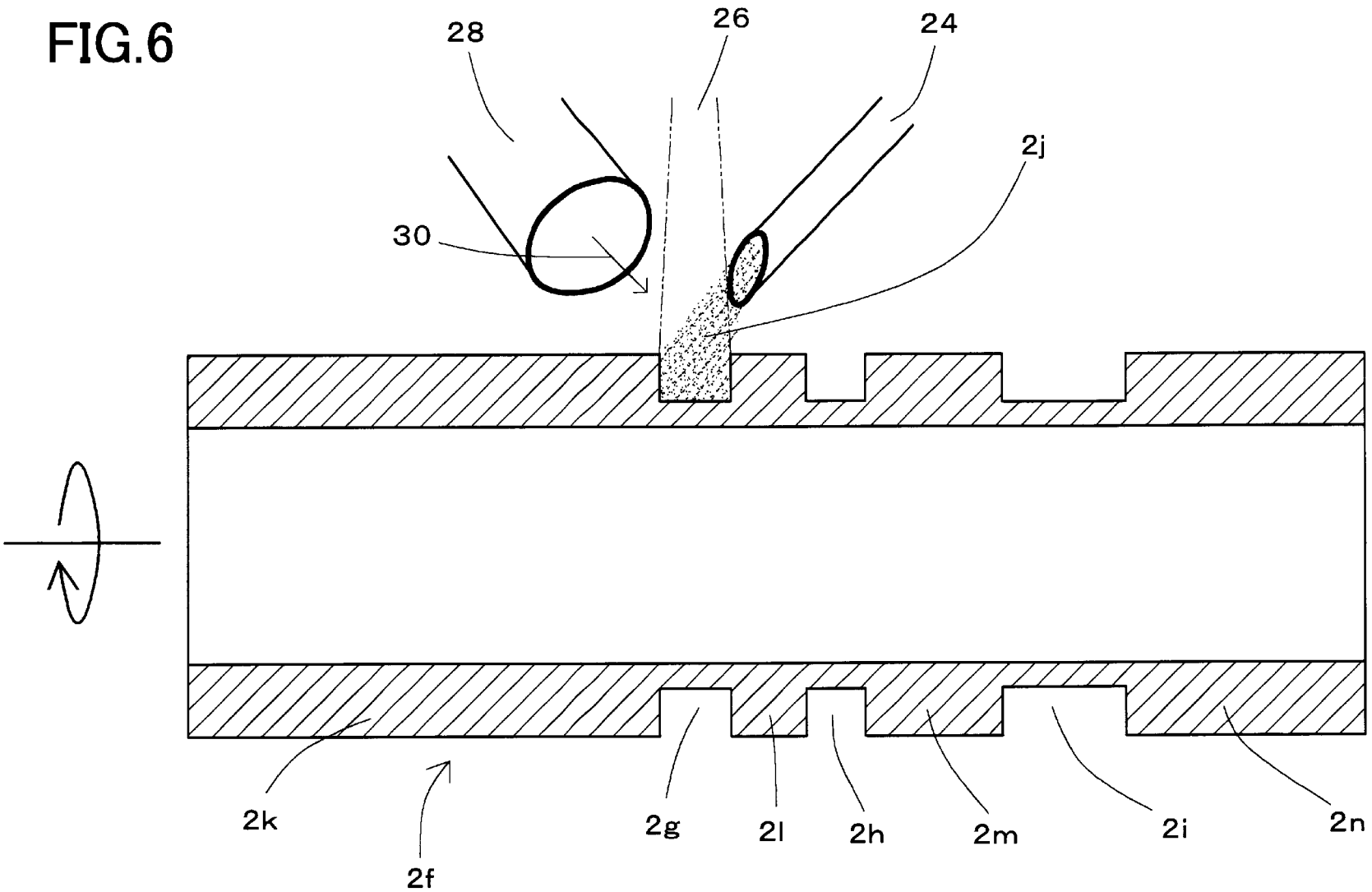
FIG. 6 depicts one step in making the common cylinder of the representative injector.

A representative method for manufacturing the representative common cylinder 2 will now be provided. As shown in FIG. 6, grooves 2*g*, 2*h*, and 2*i* may be formed in and around the periphery of a magnetic tube or cylinder 2*f* at locations corresponding to the modified portions 2*a*, 2*c* and 2*e*. At this stage of the representative manufacturing process, the outer diameter of the unfinished cylinder 2*f* is larger than the outer diameter of the finished cylinder 2. Further, the inner diameter of the unfinished cylinder 2*f* is less than the inner diameter of the finished cylinder 2. Moreover, the diameters of the bottom faces of grooves 2*g*, 2*h*, and 2*i* are less than the inner diameter of the finished cylinder 2.

After forming grooves 2*g*, 2*h* and 2*i*, a non-magnetic metal powder 2*j* may be poured into the grooves via a powder supply nozzle 24. Preferably, a laser 26 irradiates the metal powder 2*j* directly after being supplied into the groove. The cylinder 2*f* preferably rotates while the metal power 2*j* is being poured and irradiated. A shield gas 30 may be supplied to the irradiation portion via a shield gas nozzle 28. Thus, the groove 2*g* can be filled with the non-magnetic metal and the non-magnetic metal is fused to the magnetic cylinder 2*f* according to this representative method. Further information concerning a related technique can be found in Japanese Laid-Open Patent Application No. 9-312208, which teaches methods for reliably forming a magnetic path shielding portion within a magnetic material. Naturally, grooves 2*h* and 2*i* can be formed according to the same representative method.

In this representative embodiment, the unfinished cylinder 2*f* comprises a magnetized material and a non-magnetic material was used as the metal powder 2*j*. However, the unfinished cylinder 2*f* may comprise a non-magnetic material and a magnetic material may be used as the metal powder 2*j*. Thus, in the alternative, the magnetic portions 2*b* and 2*d* can be formed in a non-magnetic cylinder 2*f*.

Further, in this representative method, the unfinished cylinder 2*f* has groove portions 2*g*, 2*h*, and 2*i* that were formed within the unfinished cylinder 2*f*. However, grooves 2*g*, 2*h*, and 2*i* can be formed by aligning a plurality of annular members around a shaft. Thus, separate annular members disposed around the shaft may form portions 2*k*, 2*l*, 2*m* and 2*n*. After filling the grooves between the annular members, the shaft can be removed to provide alternating magnetic and non-magnetic portions formed within an integral, leak proof cylinder.

Figure 7:
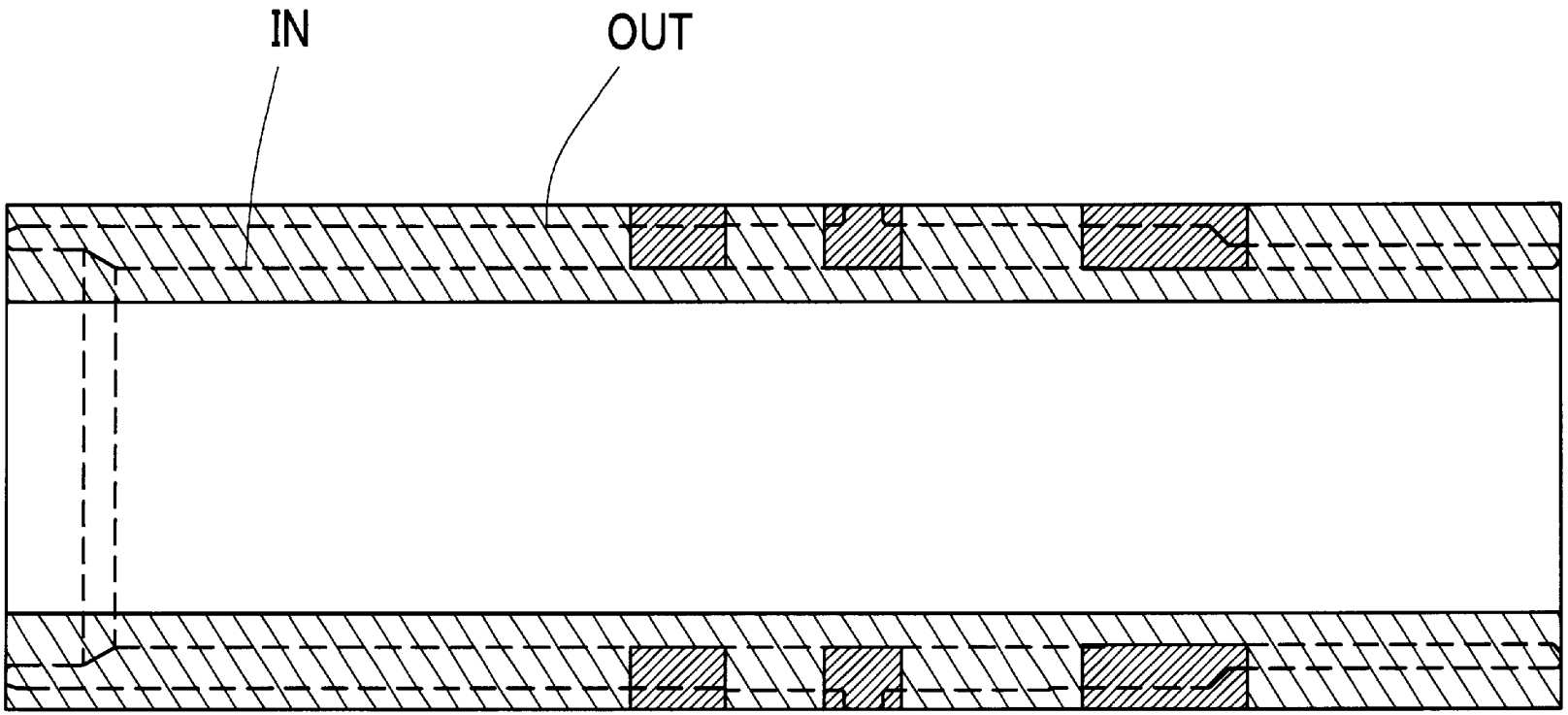
FIG. 7 depicts a second step in making the common cylinder of the representative injector.
Figure 8:
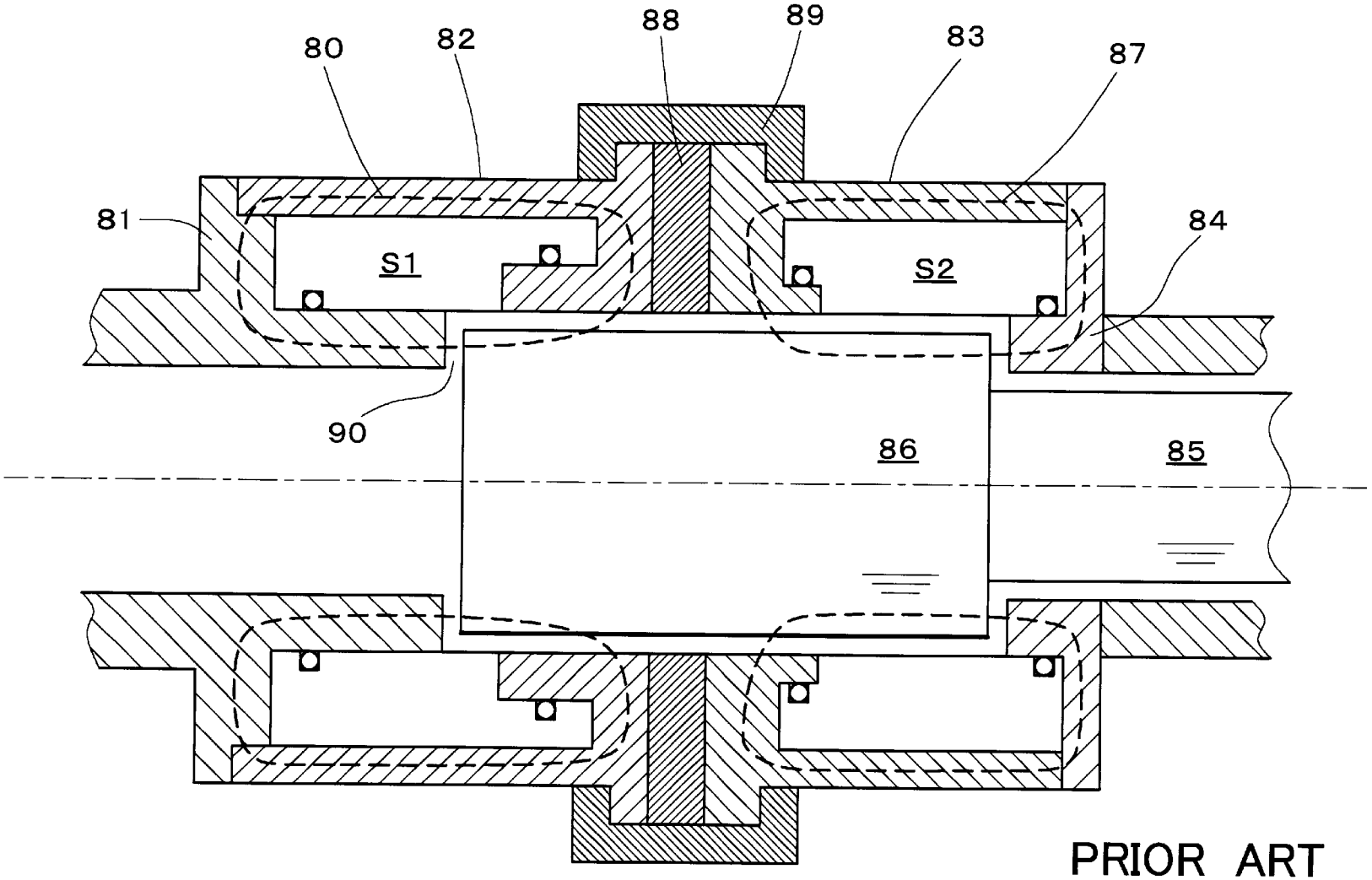
FIG. 8 depicts a known injector.

Returning to the representative method, when grooves 2*g*, 2*h*, and 2*i* have been filled with non-magnetic metal, the inner side is cut away to finish the inner surface IN, as shown by a broken line in FIG. 7, and the outer side is machined to finish the outer surface OUT. Thus, the finished common cylinder 2 is one integrated, leak proof component. Specifically, the finished cylinder 2 has ring-shaped regions that are locally modified to being non-magnetic around the entire perimeter of the cylinder 2 and the inner and outer surfaces have a precise, finished shape that is formed by machining. Thus, machining tolerances can be tightly controlled to reliably produce uniformly shaped and integrally formed common cylinders 2.

The valve-opening solenoid coil 14, the valve-closing solenoid coil 12, the core 8, the nozzle assembly 6, and the valve assembly 4 coaxially disposed within the nozzle assembly 6 are then assembled with respect to the finished cylinder 2. Because a single cylinder 2 is used and is precisely formed, the components can be precisely assembled with respect to each other. As a result, the properties of injectors manufactured according to the present teachings are extraordinarily uniform. Moreover, the cylinder 2 provides a leak proof barrier between the fuel paths 4*e*, 4*f* and the solenoid coils 12, 14.

Referring to FIG. 1, a representative method for operating the representative injector 1 will be described. When the valve assembly 4 is in the closed position, as a result of the biasing force of spring 16, current may be supplied to energize the solenoid coil 12, which further assists in maintaining the valve assembly 4 in the valve closed position. Moreover, the valve-opening solenoid coil 14 is preferably not energized when the valve assembly 4 is maintained in the valve closed position.

Naturally, the valve assembly 4 can be moved to the valve opened position by supplying current to energize solenoid coil 14 and stopping the current supplied to solenoid coil 12. The electromagnetic force generated by solenoid coil 14 must be large enough to overcome the biasing force of spring 16, so that the valve assembly 4 will move to the valve opened position.

When the valve assembly 4 should be returned to the valve closed position, current is again supplied to energize the solenoid coil 12, which assists the valve closing operation. By simultaneously stopping the electromagnetic force generated by solenoid coil 14, the movable armature 4*b* quickly moves towards the valve closed position under the combined forces of the solenoid coil 12 and the spring 16. Current can continue to be supplied to the solenoid coil 12 after the valve assembly 4 has moved to the valve closed position in order to prevent the valve assembly 4 from bouncing against the valve seat 6*f*. Thus, the valve assembly 4 will quickly stabilize in the valve closed position. After the valve assembly 4 has stabilized, current to the solenoid coil 12 may be stopped and the biasing force of spring 16 will maintain the valve assembly 4 in the valve closed position.

When current is supplied to energize the valve-opening solenoid coil 14, the magnetic path B2 generated by solenoid coil 14 extends from the rear magnetic pole 4*d* to the core 8 through the small gap between the rear magnetic pole 4*d* and the core 8. Non-magnetic portion 2*e* ensures this magnetic path, because the non-magnetic portion 2*e* is formed in the portion of the common cylinder 2 disposed adjacent to the contact point of the rear magnetic pole 4*d* and the core 8. Thus, a magnetic force is generated by solenoid coil 14 within the small gap between the rear magnetic pole 4*d* and the core 8, which forces the movable armature 4*b* towards the core 8. Due to the center nonmagnetic portion 2*c* of the common cylinder 2, the magnetic path B2 for opening the valve does not reach the front magnetic pole 4*c*. As a result, the valve assembly 4 overcomes the spring force of the spring 16 and moves along the central axis of the injector 1 towards the core 8. The seal surface 4*h* of the fuel valve 4*a* will therefore separate from the valve seat 6*f* of the nozzle 6*a* and fuel will be ejected from the fuel injection hole 6*c*.

In order to close the fuel path, valve closing solenoid coil 12 can be energized and the current to solenoid coil 14 can be stopped. Preferably, current is supplied to the valve closing solenoid coil 12 shortly before the desired time for closing the valve, because the magnetic field is not generated instantaneously. As a result of the combined force of the spring 16 and the electromagnetic force of solenoid coil 14, the armature 4*b* rapidly moves to the valve-closing position. Moreover, the valve assembly 4 quickly stabilizes in the valve-closed position, due to the extra force exerted onto the armature 4*b* by solenoid coil 12.

The magnetic path B1 generated by solenoid coil 12 extends from the front magnetic pole 4*c* to the nozzle cylinder 6*b*. through the small gap between the front magnetic pole 4*c* and the nozzle cylinder 6*b*. Non-magnetic portion 2*a* ensures this magnetic path, because the nonmagnetic portion 2*a* is formed in the portion of the common cylinder 2 disposed adjacent to the contact point of the front magnetic pole 4*c* and the nozzle cylinder 6*b*. Thus, a magnetic force is generated by solenoid coil 12 within the small gap between the front magnetic pole 4*c* and the nozzle cylinder 6*b*, which forces the movable armature 4*b* towards the nozzle cylinder 6*b*. Due to the center non-magnetic portion 2*c* of the common cylinder 2, the magnetic path B1 for closing the valve does not reach the rear magnetic pole 4*d*.

Fuel is preferably supplied to the injector 1 under pressure by a fuel pump (not shown). The fuel may filtered by the strainer 18 and supplied to the fuel path inside the core 8, which fuel path comprises fuel path 8*a* within the core 8 and the fuel paths 4*f* and 4*e* within the movable armature 4*e*. Fuel then reaches through hole 4*g* and enters a space that is between the valve assembly 4 and the nozzle assembly 6. When the nozzle surface 4*h* of the valve 4*a* separates from the valve seat 6*f* of the nozzle 6*a*, the pressurized fuel is ejected through the fuel injection hole 6*c*.

According to the representative embodiment, valve-opening solenoid coil 14 is disposed on the valve-opening side of the movable armature 4*e*. Valve-closing solenoid coil 12 is disposed on the valve-closing side of the movable armature 4*e*. The solenoid coils 12 and 14 can be coaxially disposed with high positioning precision with respect to the common cylinder 2. The representative common magnetic cylinder 2 is modified to have a non-magnetic portion in the intermediate portion 2*c* between the valve-opening solenoid coil 14 and the valve-closing solenoid coil 12. Therefore, magnetic path B2 is formed by the valve-opening solenoid coil 14 and magnetic path B1 is formed by the solenoid coil 12. These two magnetic paths are shielded from each other. Although the common cylinder 2 is disposed inside the two solenoid coils in this embodiment, it is also possible to precisely and coaxially dispose the common cylinder 2 around the outside of the two solenoids.

The representative common cylinder 2 is integrally formed and leak-proof, but has three parallel, non-magnetic portions. Thus, fuel paths 8*a*, 4*f*, and 4*e* and the solenoid coils 12 and 14 are completely separated from each other in a water-tight, leak proof manner by the common cylinder 2 and it is not necessary to use O-rings or similar structures to seal the fuel path, even if high-pressure fuels are supplied to the common cylinder 2 for long periods of time.

Moreover, by forming the common cylinder 2 using the machining and finishing techniques taught with reference to FIGS. 6 and 7, the precision of the common cylinder 2 can be high. Because the protrusion 2*z* formed on this common cylinder 2 may be utilized as a reference for positioning the other structures, the performance of the resulting injector also can be extraordinarily high and reliable.

Naturally, the present teachings are applicable to a wide variety of fuels, liquids, gases and other materials that may require injection.

What is claimed is:

1. An injector comprising:

a common cylinder comprising a first non-magnetic portion and first and second magnetic portions disposed on opposite sides of the first non-magnetic portion, the first non-magnetic portion and the first and second magnetic portions forming an integral, leak proof cylinder, wherein a substantially hollow fuel passage is defined within an interior of the common cylinder, an armature slidably disposed within the fuel passage of the common cylinder, the armature having a forward edge, a rearward edge and a substantially hollow fuel passage provided within an interior of the armature, the armature being adapted to move in response to magnetic fields, a first solenoid coil coaxially disposed about the common cylinder adjacent to the forward edge of the armature, a second solenoid coil coaxially disposed about the common cylinder adjacent to the rearward edge of the armature, wherein a space exists between the first solenoid coil and the second solenoid coil and said space is adjacent to the first non-magnetic portion of the common cylinder and a value coupled to the armature, wherein the valve closed in response to a magnetic field generated by the first solenoid coil and the valve opens in response to a magnetic field generated by the second solenoid coil.

2. An injector as in claim 1, wherein the common cylinder further comprises a second non-magnetic portion integrally connected to the first magnetic portion and disposed adjacent to the forward edge of the armature.

3. An injector as in claim 2, wherein the common cylinder further comprises a third non-magnetic portion integrally connected to the second magnetic portion and disposed adjacent to the rearward edge of the armature.

4. An injector as in claim 1, wherein the first non-magnetic portion and the first and second magnetic portions are fused together.

5. An injector as in claim 1 wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

6. An injector as in claim 1, wherein the first non-magnetic portion of the common cylinder comprises an axially formed protrusion and the axially formed protrusion extends into the space between the first solenoid coil and the second solenoid coil.

7. An injector as in claim 1, wherein the common cylinder has a machine finished surface.

8. An injector as in claim 1, wherein the common cylinder further comprises:

a second non-magnetic portion integrally connected to the first magnetic portion and disposed adjacent to the forward edge of the armature, a third non-magnetic portion integrally connected to the second magnetic portion and disposed adjacent to the rearward edge of the armature and wherein the first non-magnetic portion of the common cylinder comprises an axially formed protrusion and the axially formed protrusion extends into the space between the first solenoid coil and the second solenoid coil and wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

9. An injector as in claim 8, wherein the common cylinder has a machine finished surface.

10. An injector as in claim 8, wherein the first non-magnetic portion and the first and second magnetic portions are fused together.

11. An injector as in claim 1, wherein the substantially hollow fuel passage within the interior of the armature comprises a first fuel path and a second fuel path, the first fuel path having a diameter that is larger than the diameter of the second fuel path.

12. An injector as in claim 1, further comprising a spring disposed within the substantially hollow fuel passage of the interior of the armature, the spring biasing the armature towards a valve closing direction.

13. An injector as in claim 1, wherein the first non-magnetic portion continuously extends from an inner surface of the common cylinder to an outer surface of the common cylinder.

14. An injector as in claim 13, wherein the substantially hollow fuel passage within the interior of the armature comprises a first fuel path and a second fuel path, the first fuel path having a diameter that is larger than the diameter of the second fuel path, and further comprising a spring disposed within the first fuel path, the spring biasing the armature towards a valve closing direction.

15. An injector as in claim 14, wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

16. An injector as in claim 15, wherein the first non-magnetic portion of the common cylinder comprises an axially formed protrusion and the axially formed protrusion extends into the space between the first solenoid coil and the second solenoid coil.

17. An apparatus comprising:

a common cylinder comprising a first, second and third non-magnetic portions and first and second magnetic portions, the first and second non-magnetic portions disposed on opposite sides of the first magnetic portion and the second and third non-magnetic portions disposed on opposite sides of the second magnetic portion, the first, second and third non-magnetic portions and the first and second magnetic portions forming an integral, leak proof cylinder, an armature slidably disposed within the common cylinder, the armature having a forward edge and a rearward edge, the armature being adapted to move in response to magnetic fields, a first solenoid coil coaxially disposed about the common cylinder adjacent to the forward edge of the armature, a second solenoid coil coaxially disposed about the common cylinder adjacent to the rearward edge of the armature, wherein a space exists between the first solenoid coil and the second solenoid coil and said space is adjacent to the second non-magnetic portion of the common cylinder, and a valve coupled to the armature, wherein the valve closes in response to a magnetic field generated by the first solenoid coil and the valve opens in response to a magnetic field generated by the second solenoid coil.

18. An apparatus as in claim 17, wherein the first, second and third non-magnetic portions and the first and second magnetic portions are fused together.

19. An apparatus as in claim 18, wherein the second non-magnetic portion of the common cylinder comprises an axially formed protrusion and the axially formed protrusion extends into the space between the first solenoid coil and the second solenoid coil.

20. An apparatus as in claim 17, wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

21. An apparatus as in claim 17, wherein a substantially hollow fuel passage is defined within an interior of the armature.

22. An apparatus as in claim 21, further comprising a spring disposed within the substantially hollow fuel passage of the interior of the armature, the spring biasing the armature towards a valve closing direction.

23. An apparatus as in claim 21, wherein the substantially hollow fuel passage defined within the interior of the armature comprises a first fuel path and a second fuel path, the first fuel path having a diameter that is larger than the diameter of the second fuel path, and further comprising a spring disposed within the first fuel path, the spring biasing the armature towards a valve closing direction.

24. An apparatus as in claim 23, wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

25. An apparatus as in claim 24, wherein the second non-magnetic portion of the common cylinder comprises an axially formed protrusion and the axially formed protrusion extends into the space between the first solenoid coil and the second solenoid coil.

26. An apparatus as in claim 19, wherein the first, second and third non-magnetic portions continuously extend from an inner surface of the common cylinder to an outer surface of the common cylinder.

27. An apparatus comprising:

a common cylinder comprising a non-magnetic portion and first and second magnetic portions disposed on opposite sides of the non-magnetic portion, the non-magnetic portion and the first and second magnetic portions forming an integral, leak proof cylinder, wherein the non-magnetic portion continuously extends from an inner surface of the common cylinder to an outer surface of the common cylinder and an axially formed protrusion is disposed on the outer surface of the non-magnetic portion, an armature slidably disposed within the common cylinder, the armature having a forward edge and a rearward edge, the armature being adapted to move in response to magnetic fields, a first solenoid coil coaxially disposed about the common cylinder adjacent to the forward edge of the armature, a second solenoid coil coaxially disposed about the common cylinder adjacent to the rearward edge of the armature, wherein a space exists between the first solenoid coil and the second solenoid coil and said space is adjacent to the non-magnetic portion of the common cylinder and wherein the axially formed protrusion of the common cylinder extends into the space between the first solenoid coil and the second solenoid coil, and a valve coupled to the armature, wherein the valve closes in response to a magnetic field generated by the first solenoid coil and the valve opens in response to a magnetic field generated by the second solenoid coil.

28. An apparatus as in claim 27, wherein the non-magnetic portion and the first and second magnetic portions are fused together.

29. An apparatus as in claim 27, wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic pole.

30. An apparatus as in claim 27, wherein a substantially hollow fuel passage is defined within an interior of the armature.

31. An apparatus as in claim 30, further comprising a spring disposed within the substantially hollow fuel passage of the interior of the armature, the spring biasing the armature towards a valve closing direction.

32. An apparatus as in claim 30, wherein the substantially hollow fuel passage defined within the interior of the armature comprises a first fuel path and a second fuel path, the first fuel path having a diameter that is larger than the diameter of the second fuel path, and further comprising a spring disposed within the first fuel path, the spring biasing the armature towards a valve closing direction.

33. An apparatus as in claim 32, wherein the armature comprises a first magnetic pole disposed at the forward edge of the armature and a second magnetic pole disposed at the rearward edge of the armature, wherein a portion of the armature disposed between the first magnetic pole and the second magnetic pole is thinner than the first magnetic pole and the second magnetic portion.

34. An apparatus comprising:

a common cylinder comprising a non-magnetic portion and first and second magnetic portions disposed on opposite sides of the non-magnetic portion, the non-magnetic portion and the first and second magnetic portions forming an integral, leak proof cylinder, wherein the non-magnetic portion continuously extends from an inner surface of the common cylinder to an outer surface of the common cylinder, an armature slidably disposed within the common cylinder, the armature having a forward edge and a rearward edge, the armature being adapted to move in response to magnetic fields, a first solenoid coil coaxially disposed about the common cylinder adjacent to the forward edge of the armature, a second solenoid coil coaxially disposed about the common cylinder adjacent to the rearward edge of the armature, wherein a space exists between the first solenoid coil and the second solenoid coil and said space is adjacent to the non-magnetic portion of the common cylinder and a valve coupled to the armature, wherein the valve closes in response to a magnetic field generated by the first solenoid coil and the valve opens in response to a magnetic field generated by the second solenoid coil.

* * * * *